US006257443B1

(12) United States Patent
LaCount

(10) Patent No.: US 6,257,443 B1
(45) Date of Patent: Jul. 10, 2001

(54) NAPKIN HOLDER

(75) Inventor: Kenneth H. LaCount, Watersmeet, MI (US)

(73) Assignee: Alwin Manufacturing Co., Greenbay, WI (US)

( * ) Notice: Subject to any disclaimer, the term of this patent is extended or adjusted under 35 U.S.C. 154(b) by 0 days.

(21) Appl. No.: 09/143,724

(22) Filed: Aug. 31, 1998

(51) Int. Cl.[7] ..... B65H 1/00
(52) U.S. Cl. ..... 221/35; 221/58
(58) Field of Search ..... 221/33, 35, 34, 221/45, 46, 56, 52, 58

(56) References Cited

FOREIGN PATENT DOCUMENTS

695150 * 9/1964 (CA) ..... 221/35

OTHER PUBLICATIONS

Copy of photograph of Alwin napkin holder model 31, sold prior to Aug. 31, 1997.*
Copies of photographs of Traex Corp. napkin dispenser model 6509–12, sold prior to Aug. 31, 1997.*
Copies of photographs of Alwin napkin holder model 35, sold prior to Aug. 31, 1997.*
Copies of photographs of Alwin napkin holder model F7571, sold prior to Aug. 31, 1997.*
Copy of photograph of Alwin napkin holder model 35, sold prior to Aug. 31, 1997.*

* cited by examiner

*Primary Examiner*—Kenneth W. Noland
(74) *Attorney, Agent, or Firm*—Emrich & Dithmar

(57) ABSTRACT

A napkin holder comprising an upper wall, a lower wall and first and second sidewalls defining a housing having first and second opposed openings as provided. The holder also includes first and second plates disposed and moveable within the housing. The first and second plates respectively have first and second outer peripheries. The holder further includes a biasing structure disposed between the first and second plates biasing the first plate toward the first opening and the second plate toward the second opening. The biasing structure is disposed substantially within both the first and second outer peripheries. The holder also has first and second apertured doors respectively closing the first and second openings. The first apertured door, the first plate, the upper wall, the lower wall and the first and second sidewalls define a first variable-volume napkin compartment, and the second apertured door, the second plate, the upper wall, the lower wall and the first and second sidewalls define a second variable-volume napkin compartment.

18 Claims, 3 Drawing Sheets

NAPKIN HOLDER

BACKGROUND OF THE INVENTION

1. Field of the Invention

This invention relates to paper dispensers, and more particularly to napkin holders.

2. Description of the Prior Art

In the past, napkin holders have included a multi-piece housing having openings at its longitudinal ends, two apertured doors each hingedly coupled to a respective end of the housing for closing the opening. These doors are maintained in the closed position by elaborate multi-piece structures.

These holders also included two plates disposed in the housing and having a smaller area than the cross-sectional area of the housing. The two plates are each fixedly coupled to a longitudinal end of leaf spring attached at its center to a mechanism disposed on the top wall of the housing. Two variable volume napkin compartments are each formed from one of the plates, and the doors and a portion of the housing.

These type holders suffer several problems. First, they are formed of many pieces which adds more to the raw material and labor costs necessary to construct the holder.

Second, if the leaf spring becomes damaged it is often necessary to replace both the leaf spring and the plates. If the plates can be salvaged and the leaf spring alone needs to be replaced, the replacement is often difficult, time consuming and labor intensive.

Third, each longitudinal end of the leaf spring exerts a force on the plate to which it is affixed independent of the force of the other longitudinal end. Often each of the two napkin holder compartments are overfilled, making it difficult to remove the first few napkins, which cause the napkins to tear or a larger than necessary amount to be removed. Since the force on each plate is independent, both compartments have this problem.

SUMMARY OF THE INVENTION

It is a general object of the invention to provide an improved napkin holder, while affording additional structural and operating advantages.

An important feature of the invention is the provision of a napkin holder which is of relatively simple and economical construction.

A further feature of the invention is the provision of a holder of the type set forth, the napkin capacity of which can easily be determined without opening its doors.

A still further feature of the invention is the provision of a holder of the type set forth, which can easily be repaired.

Yet another feature of the present invention is the provision of a napkin holder which easily allows removal of napkins therefrom, preventing destruction and waste of the napkins and user frustration.

One or more of these features may be attained by providing a napkin holder which includes an upper wall, a lower wall and first and second sidewalls defining a housing having first and second opposed openings. The holder also includes first and second plates disposed and moveable within the housing, the first and second plates respectively having first and second outer peripheries. The holder further includes a biasing structure disposed between the first and second plates biasing the first plate toward the first opening and the second plate toward the second opening, the biasing structure disposed substantially within both the first and second outer peripheries. The holder also includes first and second apertured doors respectively closing the first and second openings. The first apertured door, the first plate, the upper wall, the lower wall and the first and second sidewalls define a first variable-volume napkin compartment and the second apertured door, the second plate, the upper wall, the lower wall and the first and second sidewalls define a second variable-volume napkin compartment.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DETAILED DESCRIPTION OF THE PREFERRED EMBODIMENT

Figure 1:
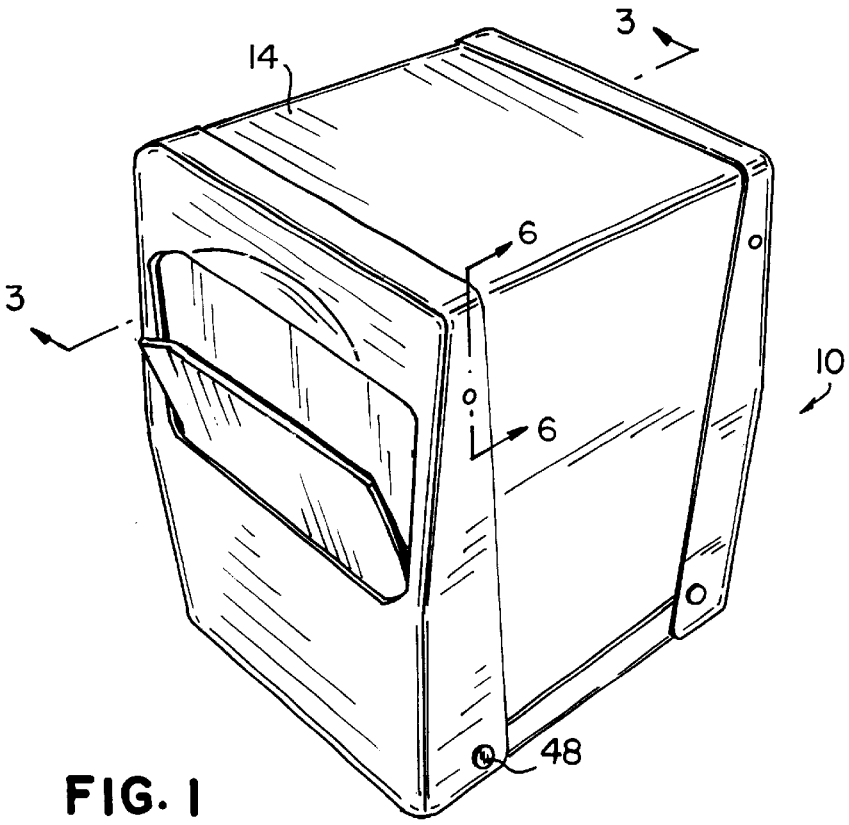
FIG. 1 is a perspective view of the napkin holder of the present invention.

Referring to FIGS. 1–7, a napkin holder 10 is provided. The napkin holder includes a one-piece housing 12. The housing 12 includes a top wall 14, an apertured.bottom wall 16, and two substantially parallel sidewalls 18, 20. Sidewalls 18, 20 respectively have end portions 34, 36 and central portions 38, 40 respectively disposed between the end portions 34, 36.

Figure 2:
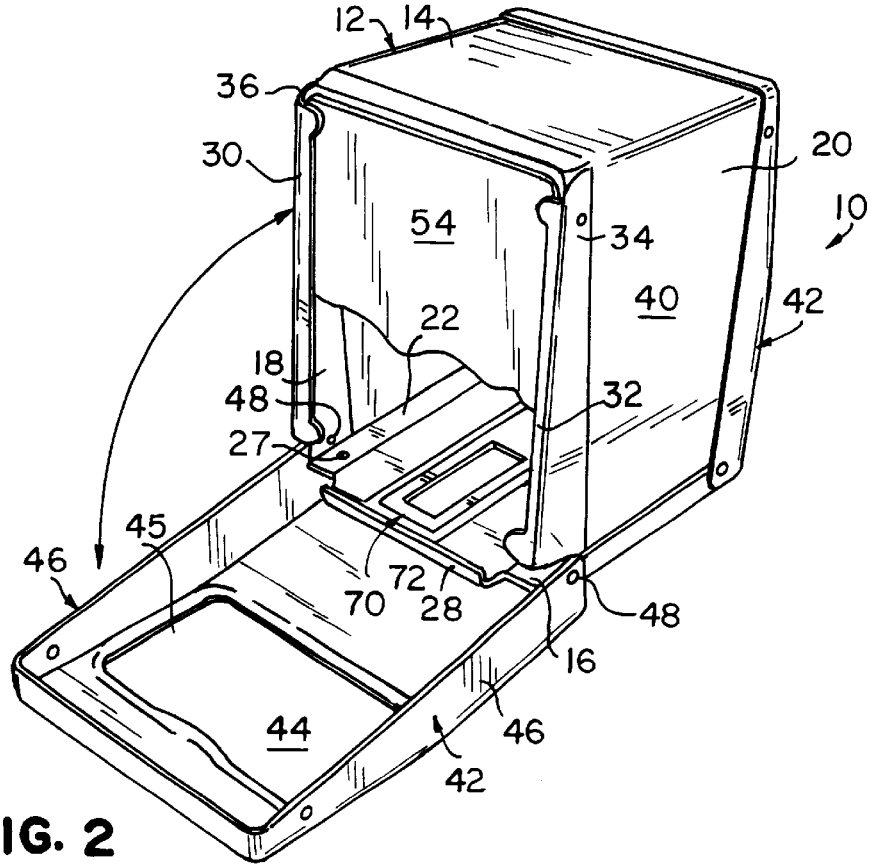
FIG. 2 is a perspective view, partially broken away of the napkin holder of FIG. 1, wherein one of the apertured doors is in an open condition.
Figure 4:
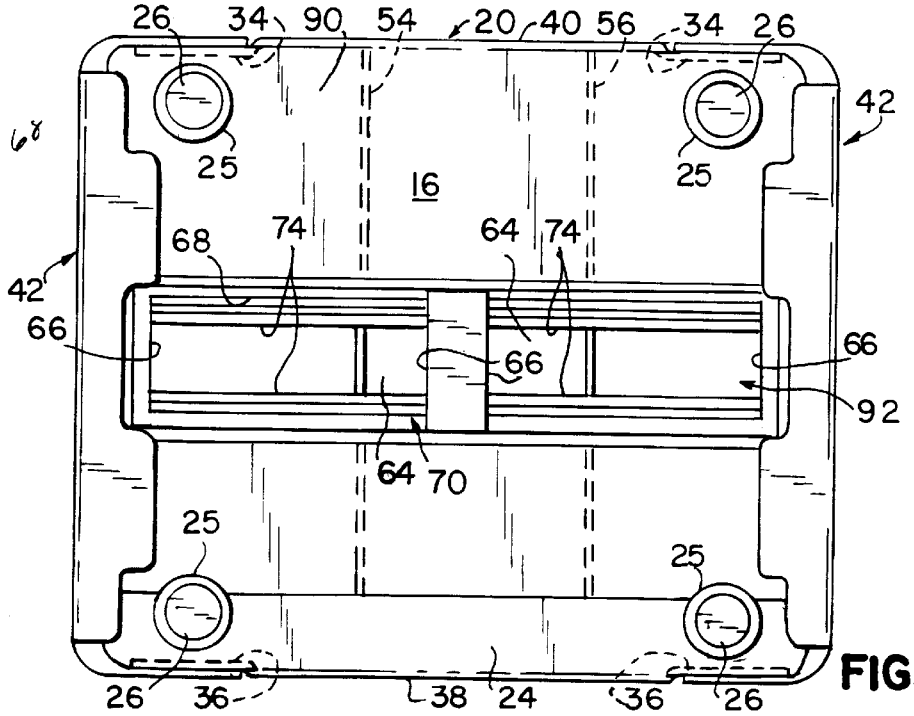
FIG. 4 is a bottom plan view of the napkin holder of FIG. 1.
Figure 5:
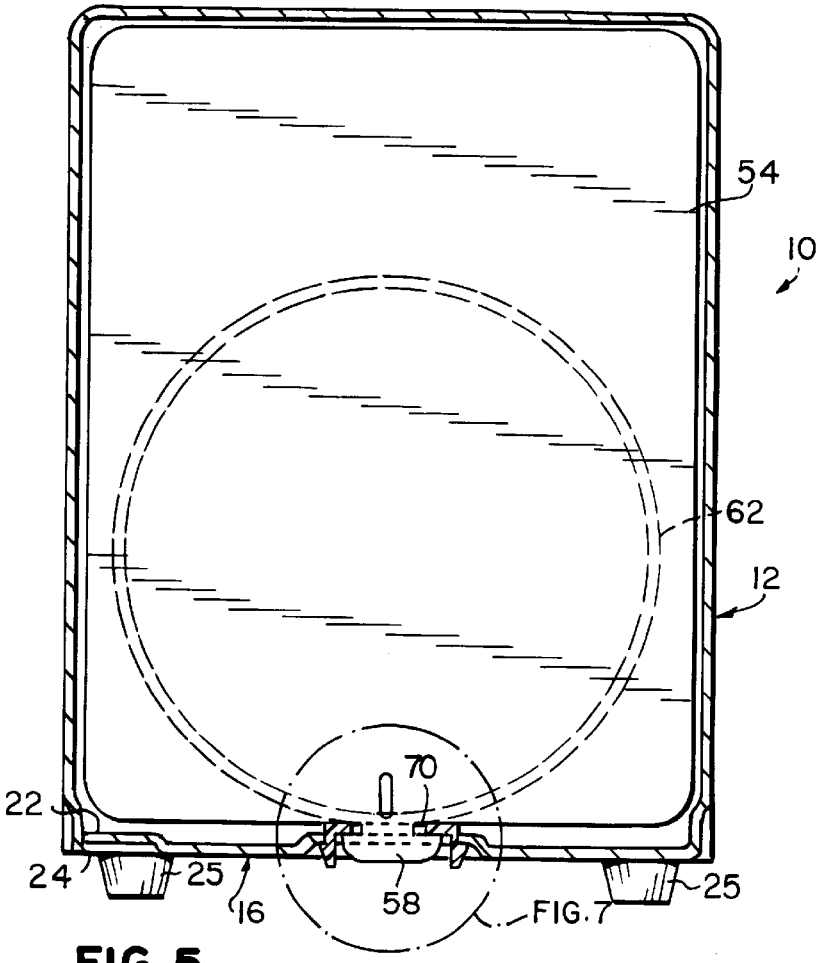
FIG. 5 is a sectional view taken generally along line 5—5 of FIG. 3.

As best seen in FIGS. 2, 4 and 5, the bottom wall 16 includes a raised portion 22 (or first ply), and a flange 24 (or second ply) attached to the sidewall 18 and disposed underneath the raised portion 22. The napkin holder 10 also includes four legs 25 connected by rivets 26 to the bottom wall 16. In that respect, the raised portion 22 is riveted to the flange 24 by two of these rivets 26 to form an integral housing 12.

The housing 12 has a longitudinal axis and two openings 27 respectively disposed at opposite longitudinal ends of the housing 12. Each opening 27 is defined in part by an upstanding flange 28 integrally disposed on the bottom wall 16 and side flanges 30, 32 respectively integrally projecting from the end portions 34, 36 of sidewalls 18, 20. As seen best in FIG. 4, the distance between end portions 34, 36 is less than the distance between central portions 38, 40 of sidewall 18, 20.

The holder 10 also includes two doors 42. Each door 42 includes a front wall 44 having a substantially rectangular aperture 45 and two sidewalls 46 substantially parallel to one another. Each door 42 is hingedly coupled to the housing 12 by a pair of rivets 48 (or other type fastener) respectively passing through a bottom portion of a sidewall 46 and a bottom portion of an associated end portion 34, 36. Each door 42 has a closed position, as seen in FIG. 1, wherein the sidewalls 46 are respectively disposed over end portions 34, 36 and an open position wherein the top of the door 42 is swung away from the housing 12 in the direction of arrow A (FIG. 2). When the door 46 is in the open position, napkins can easily be placed within the housing 12.

Figure 6:
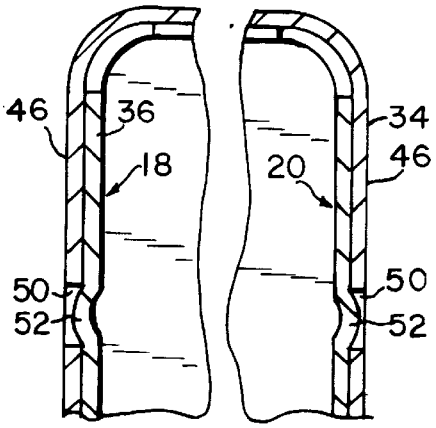
FIG. 6 is an enlarged, partial sectional view taken generally along the line 6—6 of FIG. 1.

The doors 42 are maintained in the closed position as follows. Each door sidewall 46 has an aperture 50 at its upper end (FIG. 6). As seen best in FIG. 6, the distance between the door sidewalls 46 is substantially equal to or slightly greater than the distance between the exterior surfaces of end portions 34, 36. Each end portion 34, 36 of the housing sidewalls 18, 20 has a bulge 52 (or locking projection) respectively projecting therefrom. When the doors 42 are placed in the closed position the bulges 52 are respectively received in the apertures 50 to removeably retain the door 42 in the closed position. The distance between the exterior of the bulges 52 is greater than the distance between the interior of the sidewalls 46. To accommodate this retaining ability, the doors 42 are formed of a somewhat flexible material, such as a thin metal, so that the portions of sidewalls 46 surrounding the apertures 50 can be flexed to ride over the bulge 52 to allow the bulge 52 to be placed in an aperture 50 to allow the door to be moved to and from the closed position.

Disposed within the housing 12 are first and second substantially planar plates 54, 56. Each plate 54, 56 respectively has an outer periphery, a bottom end and a t-shaped projection 58, 60 projecting from the bottom end. As seen best in FIG. 3, each plate 54, 56 has an area substantially equal to the cross-sectional area of the housing 12.

The holder 10 also includes a biasing structure, such as a coil spring 62 disposed in the housing 12 between the plates 54, 56. Preferably, the coil spring 62 is not attached to either of the plates 54, 56.

As discussed above, the bottom wall 16 is apertured and includes two spaced-apart rectangular apertures 64 running along the center of the width of the bottom wall 16. Each aperture 64 is formed of two substantially parallel end walls 66 substantially perpendicular to sidewalls 18, 20 and two substantially parallel sidewalls 68 (FIGS. 4 and 7) substantially parallel to sidewalls 18, 20.

Figure 7:
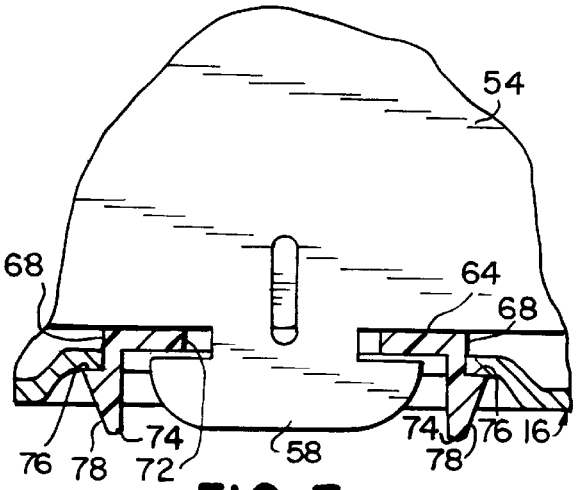
FIG. 7 is an enlarged sectional view of the napkin holder indicator and guide channel of FIG. 5.

The napkin holder 10 also includes an insert 70 made of a flexible material, such as plastic, and having two rectangular apertures 72, each smaller in area than aperture 64. As discussed below, the apertures 72 act as guide channels for the movement of the plates 54, 56. As seen in FIGS. 4, 5 and 7, the insert 70 has two spaced-apart pairs of legs 74. As best seen in FIG. 7, each leg 74 has a portion 76 for contacting sidewall 68 of aperture 64, a locking shoulder 76 to engage the exterior of the bottom wall 16 and a sloped portion 78. Each leg 74 has a length slightly less than the length of sidewall 68 of aperture 64 of the bottom wall 16. The insert 70 is connected to the bottom wall 16 of the housing 12 by pushing the sloped portion 78 of the legs 72 through aperture 64 until the shoulder 76 clears the exterior bottom wall 16 snap-locking the shoulders 76 into place in a known manner.

Figure 3:
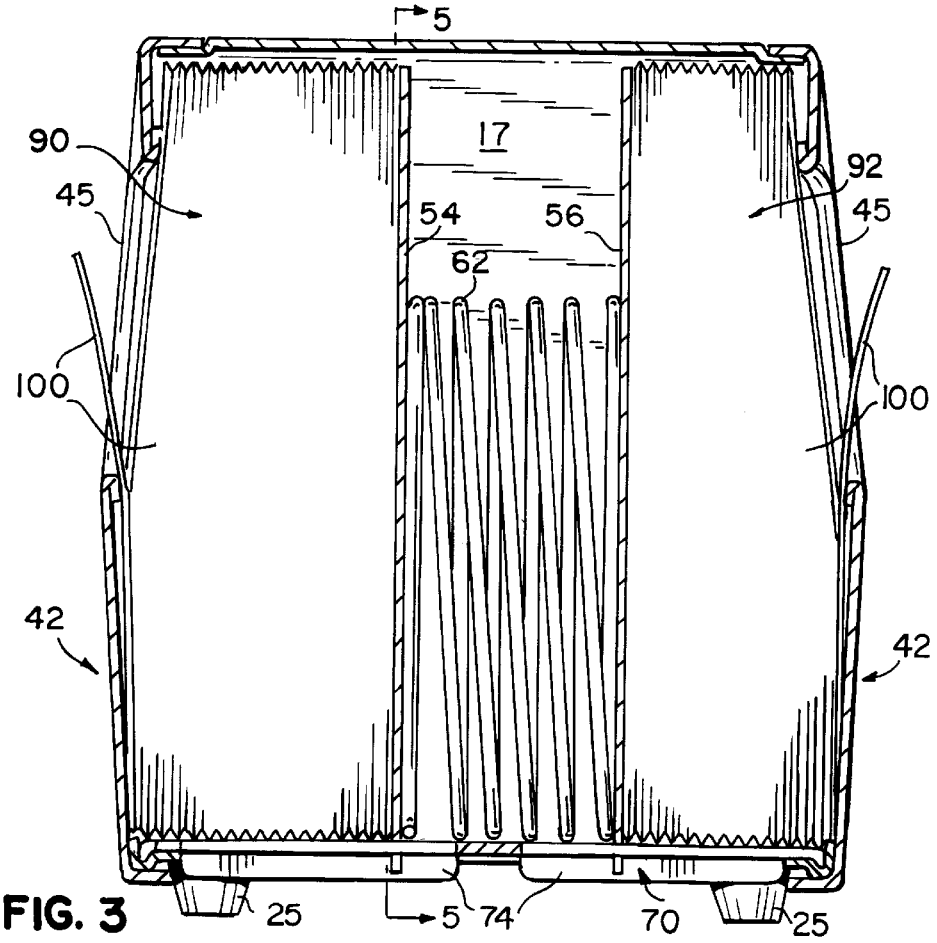
FIG. 3 is a is a sectional view of the napkin holder of FIG. 1 taken generally along line 3—3 of FIG. 1.

When the holder 10 is fully assembled, the plates 54, 56 are substantially parallel to each other and the t-shaped projections 58, 60 of plates 54, 56 are respectively disposed through an aperture 72 of the insert 70 (and an aperture 64 of the bottom wall 16) and have portions which lie outside the housing 12. The coil spring 62, as seen in FIGS. 3 and 5 is disposed within the housing 12 between the plates 54, 56 within the outer periphery of both the plates 54, 56. The coil spring 62 exerts a principal force on plates 54, 56 that is substantially perpendicular to each plate 54, 56 and substantially parallel to the bottom wall 16 forcing the plates toward respective openings 27. As discussed below, the force exerted by the coil spring 62 on each plate 54, 56 is substantially equal.

As seen in FIGS. 3 and 4, plate 54, sidewalls 18, 20 and the door 42 form a first variable volume napkin compartment 90 and plate 56, sidewalls 18, 20 and the door 42 form a second variable volume napkin compartment 92.

Napkins 100 are placed in compartments 90, 92 by placing a respective door 42 in an open condition and increasing the volume of the respective compartments 90, 92 by pushing the plate 54 or 56 toward the center of the napkin holder 10 thereby compressing the coil spring 62. The napkins 100 are retained in place by returning the door 42 back to its closed position. The more napkins 100 placed in the compartments 90, 92, the closer the respective plates 54, 56 are moved to the center of the napkin holder 10.

Napkins 100 are removed through the apertures 45, in a known manner. When napkins 100 are removed, the respective plate 58, 60 move closer to a respective door 42 and the volume of the respective compartment 90, 92 becomes smaller. The walls of apertures 64 and 72 through which the t-shaped projections 58, 60 of plates 54, 56 are disposed, act as channels to guide the plates 54, 56 to move along the longitudinal axis of the housing As seen in FIGS. 3 and 4, the t-shaped projections 58, 60 disposed outside and underneath the housing 12 act as visual indicators to indicate the amount of napkins in each compartment 90, 92 thereby advantageously not requiring a user to open the doors 42 to insert the amount of napkins in compartments 90, 92. The t-shaped projections 58, 60 also help maintain the plates 54, 56 within the napkin holder 10, when the doors 42 are opened to refill the napkins 100.

The present invention has significant advantages over the prior napkin holders. First, since the coil spring 62 exerts a principle force perpendicular to plates 54, 56, the plates 54, 56 respectively apply an outward force generally over the entire area of the napkins which prevents bunching or wrinkling of the napkins 100.

Additionally, since the coil spring 62 applies the same force on both plates 54, 56, waste, destruction and excess removal of napkins is prevented. When the compartments 90, 92 are overfilled, the first few napkins are difficult to remove since the coil spring 62 is highly compressed and exerts a large force on both plates 54, 56. As referred to earlier, the result is tearing and excess removal of the napkins when the napkins are removed from one of the overfilled compartments 90 or 92. Advantageously, only one compartment 90 or 92 may be so effected because when, for example, napkins are removed from compartment 90, the coil spring 62 elongates and applies less force to both plates 54, 56 and thus makes it easier to remove napkins 100 from both compartment 92, as well as compartment 90.

While particular embodiments of the present invention have been shown and described, it will be appreciated by those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. A napkin holder comprising:

an upper wall, a lower wall and first and second sidewalls defining a housing having first and second opposed openings and a guide member on one of said walls;

first and second plates disposed and moveable within the housing, the first and second plates respectively having first and second outer peripheries;

guide structure on one of said first and second plates for cooperation with said guide member on said housing walls biasing structure freely disposed between the first and second plates biasing the first plate toward the first opening and the second plate toward the second opening, the biasing structure disposed substantially within both the first and second outer peripheries; and first and second apertured doors respectively closing the first and second openings, the first apertured door, the first plate, the upper wall, the lower wall and the first and second sidewalls defining a first variable volume napkin compartment, the second apertured door, the second plate, the upper wall, the lower wall and the first and second sidewalls defining a second variable volume napkin compartment, wherein said guide member and said guide structure cooperate during movement of at least one of said plates forward and away from the respective first and second openings.

2. The holder of claim 1, wherein the biasing structure respectively applies first and second biasing forces on the first and second plates, wherein the first and second biasing forces are substantially equal.

3. The holder of claim 1, wherein the biasing structure is a coil spring.

4. The holder of claim 1, wherein the first and second plates are substantially planar and substantially parallel to one another, and the biasing structure exerts a principal force on and substantially perpendicular to the first and second plates.

5. The holder of claim 1, wherein the first and second projections are t-shaped.

6. The holder of claim 1, wherein the upper wall, the lower wall, and the first and second sidewalls are a one-piece construction.

7. A napkin holder comprising:

an upper wall, a lower wall and first and second sidewalls defining a housing having first and second opposed openings;

first and second plates disposed and moveable within the housing;

biasing structure disposed between the first and second plates biasing the first plate toward the first opening and the second plate toward the second opening; and first and second apertured doors respectively closing the first and second openings, the first apertured door, the first plate, the upper wall, the lower wall and the first and second sidewalls defining a first variable-volume napkin compartment, the second apertured door, the second plate, the upper wall, the lower wall and the first and second sidewalls defining a second variable volume napkin compartment; and first and second indicators respectively indicating the amount of napkins in the first and second napkin compartments, each of the first and second indicators having a portion disposed outside the housing.

8. The holder of claim 7, wherein the bottom wall has two apertures respectively defining first and second channels and the first and second indicators respectively project from the first and second plates and are respectively disposed through the first and second channels.

9. The holder of claim 8, wherein the first and second indicators are t-shaped.

10. The holder of claim 7, wherein the upper wall, the lower wall, and the first and second sidewalls are a one-piece construction.

11. The holder of claim 10, wherein a portion of the bottom wall is formed of a first ply coupled to and extending from the first sidewall and a second ply coextensive with the remainder of the bottom wall overlapping the first ply, and further comprising at least one leg and a fastener coupling the first ply to the second ply and the leg to the first and second plies.

12. The holder of claim 7, wherein the first and second sidewalls respectively have first and second locking projections and the first door has first and second apertures respectively sized to receive the first and second locking projections to removeably retain the first door in a closed position closing the first opening.

13. The holder of claim 12, wherein the first and second sidewalls respectively have third and fourth locking projections and the second door has third and fourth apertures respectively sized to receive the third and fourth locking projections to removeably retain the second door in a closed position closing the second opening.

14. A napkin holder comprising:

an upper wall, a lower wall and first and second sidewalls defining a housing having first and second opposed openings and a longitudinal axis;

first and second substantially planar plates disposed and moveable within the housing, the first and second plates disposed substantially parallel to one another, the first slate including a guide member;

biasing structure respectively biasing the first plate toward the first opening and the second plate toward the second opening;

first and second apertured doors respectively closing the first and second openings, the first apertured door, the first plate, the upper wall, the lower wall and the first and second sidewalls defining a first variable-volume napkin compartment, the second apertured door, the second plate, the upper wall, the lower wall and the first and second sidewalls defining a second variable-volume napkin compartment; and guiding structure integrally formed in one of the walls of the housing engageable with the first guide member, wherein the guide member and guide structure cooperate to guide the first plate in a direction substantially parallel to the longitudinal axis.

15. The holder of claim 14, wherein the biasing structure is a coil spring freely disposed between the first and second plates.

16. The holder of claim 14, wherein the guide structure includes an aperture defining a channel and the guide member includes a projection disposed through the channel.

17. The holder of claim 16, wherein the aperture is disposed in the bottom wall and the projection is t-shaped.

18. A napkin holder comprising:

an upper wall, a lower wall and first and second sidewalls defining a housing having first and second opposed openings;

first and second plates disposed and moveable within the housing, the first and second plates respectively having first and second outer peripheries;

said lower wall having two apertures respectively defining first and second channels and the first and second plates respectively have first and second projections respectively disposed through the first and second channels, biasing structure freely disposed between the first and second plates biasing the first plate toward the first opening and the second plate toward the second opening, the biasing structure disposed substantially within both the first and second outer peripheries; and first and second apertured doors respectively closing the first and second openings, the first apertured door, the first plate, the upper wall, the lower wall and the first and second sidewalls defining a first variable-volume napkin compartment, the second apertured door, the second plate, the upper wall, the lower wall and the first and second sidewalls defining a second variable-volume napkin compartment.

* * * * *